United States Patent [19]

von Rühling

[11] Patent Number: 4,579,280

[45] Date of Patent: Apr. 1, 1986

[54] PROCESS FOR HEATING THE SURFACE OF A SUBSTRATE USING A HOT GAS JET, PARTICULARLY EMPLOYING SIMULTANEOUS FEED OF A COATING SUBSTANCE FOR USE IN THE FLAME SPRAYING PROCESS, AND BURNER FOR CARRYING OUT THE PROCESS

[75] Inventor: Felix von Rühling, Ratingen-Lintorf, Fed. Rep. of Germany

[73] Assignee: Akzo N.V., Arnhem, Fed. Rep. of Germany

[21] Appl. No.: 701,436

[22] Filed: Feb. 12, 1985

Related U.S. Application Data

[63] Continuation of Ser. No. 382,616, May 27, 1982, abandoned.

[30] Foreign Application Priority Data

May 29, 1981 [DE] Fed. Rep. of Germany ..... 3121370

[51] Int. Cl.[4] ..... B05B 1/24

[52] U.S. Cl. ..... 239/8; 239/79; 239/400; 239/405; 239/419.3; 239/419.5; 239/425; 239/427.5

[58] Field of Search ..... 239/8, 11, 9, 79, 82, 239/85, 400, 404, 405, 419.3, 419.5, 424, 424.5, 425, 425.5, 427.3, 427.5, 428

[56] References Cited

U.S. PATENT DOCUMENTS

| | | | |
|---|---|---|---|
| 364,101 | 5/1887 | Gill et al. | 239/424 |
| 586,066 | 7/1897 | Sams | 239/422 |
| 992,181 | 5/1911 | Foss | 239/427.3 |
| 1,421,844 | 7/1922 | Schmidt . | |
| 1,824,397 | 9/1931 | Ellsberg . | |
| 1,995,934 | 3/1935 | Mangold | 239/422 |
| 2,466,100 | 4/1949 | Harrah | 239/419.5 |
| 2,544,259 | 3/1951 | Duccini et al. | 239/79 |
| 3,620,454 | 11/1971 | Broderick et al. | 239/79 |
| 3,929,291 | 12/1975 | Ladisch | 239/425 |
| 4,313,721 | 2/1982 | Henriques | 239/424.5 |
| 4,368,846 | 1/1983 | Rau et al. | 239/427.5 |
| 4,411,935 | 10/1983 | Anderson | 239/79 |

FOREIGN PATENT DOCUMENTS

| | | | |
|---|---|---|---|
| 1055409 | 4/1959 | Fed. Rep. of Germany . | |
| 1097327 | 1/1961 | Fed. Rep. of Germany . | |
| 2838500 | 3/1980 | Fed. Rep. of Germany . | |
| 493478 | 5/1919 | France . | |
| 21010 | 6/1929 | Netherlands | 239/79 |
| 1857 | of 1895 | United Kingdom | 239/424 |
| 7338 | of 1915 | United Kingdom . | |
| 671864 | 5/1952 | United Kingdom | 239/79 |
| 675503 | 7/1952 | United Kingdom . | |
| 1245393 | 9/1971 | United Kingdom | 239/424 |
| 748089 | 7/1980 | U.S.S.R. | 239/424 |

*Primary Examiner*—Andres Kashnikow
*Assistant Examiner*—Michael J. Forman
*Attorney, Agent, or Firm*—Howard M. Ellis; Michael L. Dunn

[57] ABSTRACT

The invention relates to a process for heating the surface of a substrate and to a burner particularly as part of a spray gun suitable for carrying out the process of flame spraying. In order to improve flame stability and to increase the output, compressed air is supplied using annular guide plates arranged in cascade fashion, one above the other and one behind the other in various planes in the direction of the jet. As a result of this, kinetic energy is introduced into the flow of hot gases as the air volume increases, so that almost complete combustion of the hot gases can be achieved at relatively low end temperatures. The drop-off in temperature of the hot gases in the direction of flow starting from the mouth of the burner is relatively small. Consequently, it is also possible to heat substrates uniformly which, as a result of their particular shape, have a varying spacing from the mouth of the burner. Using the burner, it is even possible to heat shrink films used for packaging objects without over-heating, leading to local destruction of the material, occurring.

21 Claims, 3 Drawing Figures

PROCESS FOR HEATING THE SURFACE OF A SUBSTRATE USING A HOT GAS JET, PARTICULARLY EMPLOYING SIMULTANEOUS FEED OF A COATING SUBSTANCE FOR USE IN THE FLAME SPRAYING PROCESS, AND BURNER FOR CARRYING OUT THE PROCESS

This is a continuation of application Ser. No. 382,616, filed May 27, 1982, now abandoned.

BACKGROUND OF THE INVENTION

The invention relates to a process for heating the surface of a substrate using a hot gas jet, particularly employing simultaneous feed of a substance for carrying out surface treatment or coating in accordance with the flame spraying process, in which the combustion gas to be mixed with the combustion air and which is supplied in an annular fashion is accelerated towards the surface to be heated by introducing compressed air in the form of a pumping jet.

The invention further provides a burner for heating the surface of a substrate, particularly in combination with a nozzle for the substance used for the surface treatment or coating and used in the flame spraying process consisting of a preferably coaxial nozzle for compressed air having an axial flow component and an annular guide plate surrounding the nozzle and spaced therefrom defining an annular channel having openings at its rear for the introduction of air and further comprising a concentrically arranged combustion gas nozzle.

In the case of a known burner of this type, the compressed air supplied through the axial nozzle simultaneously transports the coating substance in particulate form. Using the injector principle, the pumping jet of compressed air sucks in air from the outside via the annular channel which is open at the back. The air which is drawn in becomes mixed, in the annular channel, with the combustion gas which is fed in by means of an annular nozzle located at the outer edge of the annular channel, so that a crown-shaped flame results which surrounds, in the form of a mantle, the central cone-shaped compressed air jet loaded with the particles of coating substance, so that between this mantle and the cone-shaped compressed air jet, a jacket made up by the air which has been drawn in is formed. The hot gas flame mantle heats the surface to be coated and dries it. Additionally, it shields the cone-shaped compressed air jet from external influences and heats it using radiation and turbulence along its path from the outlet from the nozzle up to the surface to be coated.

The advantages of a method carried out using a burner of this type consist in the fact that coating occurs in a region where the moisture content of the air is extremely low. The necessary heat energy required for drying the surface can be produced sufficiently rapidly and carried along without the temperature along the transport path becoming too high. It is even possible to add flammable and low boiling point solvents to the coating substance without them becoming ignited during the spraying process. These advantages justify the succesful use of the known process and the known burner as the flame spraying gun; nevertheless, the burner is not devoid of disadvantages. Thus, pulsation of the flow is found to occur which leads to incomplete combustion of the combustion gases. Pulsation also leads to uneven heating of the surface, since the flame then tends to oscillate. When the pulsation becomes too great it can even bring about extinction of the flame.

SUMMARY OF THE INVENTION

The object of the invention is to provide a process and a burner of the type stated above in which the performance and flame stability are improved.

This object is achieved in the stated process as a result of the fact that additional compressed air in the form of at least one further pumping jet having axial flow components is supplied in a plane which is displaced with respect to the plane of the outlet of the compressed air of the first pumping jet. Preferably, further air from outside should be supplied in order to increase the jet cross-section between the mouth planes of the pumping jets. The additional pumping jet can be discharged from a central nozzle, a slit-like nozzle or a crown nozzle. It is further advantageous when combustion gas is supplied coaxially in several axially displaced planes.

In the case of this invention, the improvement in performance and flame stability results from the multiple acceleration of the hot combustion gases and the cascade-like widening of cross-section with the simultaneous introduction of air. Measurements have shown that combustion with a CO content of less than 0.1 vol. % is achieved.

Using the provisions in accordance with the invention, a transformation of the high combustion gas temperature to a lower temperature of the hot gases occurs at a high flow velocity of these gases in a pressureless concentric system. This is the prerequisite for a good coefficient of heat transfer to the surface to be heated. The low level of temperature fall of the discharged hot gases in the flow direction is also of advantage. Consequently, using the process in accordance with the invention, it is even possible to heat bodies which are very sensitive to excessive temperatures. Thus, using the process in accordance with the invention it is even possible to heat shrink films used in the packaging of objects, without only small changes of spacing immediately leading to over-heating of the shrink film.

Using the process in accordance with the invention, it is not only possible to carry out stationary processes, but also to operate continuously in order to carry out surface heating, drying, and coating e.g. in the continuous coating of tubes or strips.

Concerning the burner of the above-stated type, the stated aim can be achieved by providing for the first annular guide plate to be surrounded by at least one further guide plate of larger diameter and having openings at its rear for the introduction of air or by providing at least one further nozzle, which in particular is coaxial, for the introduction of compressed air having axial flow components or, finally, by combining both of the above-stated provisions.

Where one or several additional annular guide-plates are provided, it has been found advantageous when the next greater one extends in cascade fashion beyond the forward end of the respective smaller annular guide plate. It is further advantageous when the respective additional nozzle for compressed air is arranged inside the larger cross-section, particularly the projecting cross-section of the greater annular guide-plate.

In order to regulate the temperature of the flame the openings in the back of the annular channel, provided for the air, can have throttling components associated with them. The throttling components may be formed by a perforated disc. These components may also take the form of inclined vanes which then impart a twist to the air which is introduced which favours swirling of the air. Both the perforated disc as well as the inclined vanes can be used as a spacer and supporting component between the annular guide plates.

Both the burner and the spray gun can be used in an oxygen-free atmosphere if each annular channel is closed off at the back, up to the openings for the admission of air, and the openings are connected to a conduit for supplying compressed air. In order to use the burner or the spray gun under water, the forward end of the burner is also closed off right up to the central opening by means of an annular plate. When using the burner under salt water, a nozzle for a rinsing medium having a jet direction passing through the central opening should be provided, whereby, in particular, an annular guide plate is connected to the opening. The rinsing medium then cleans the surface which is to be coated in order to remove residues resulting during drying, such as, for example, salt.

In order to clean up the heated surface and remove dirt or in order to pretreat it, in order to activate it for a surface reaction with the coating medium, a further nozzle can be provided for a gaseous or liquid medium the jet of which is directed onto the region of the substrate where the hot gases impinge, this nozzle being provided externally of the burner head.

BRIEF DESCRIPTION OF THE DRAWINGS

Below, the invention will be described in greater detail with respect to the drawings which show several embodiments of the invention. Individually these show.

DETAILED DESCRIPTION OF THE INVENTION

In all examples of embodiments, the burner and the spray gun have a concentric construction.

Figure 1:
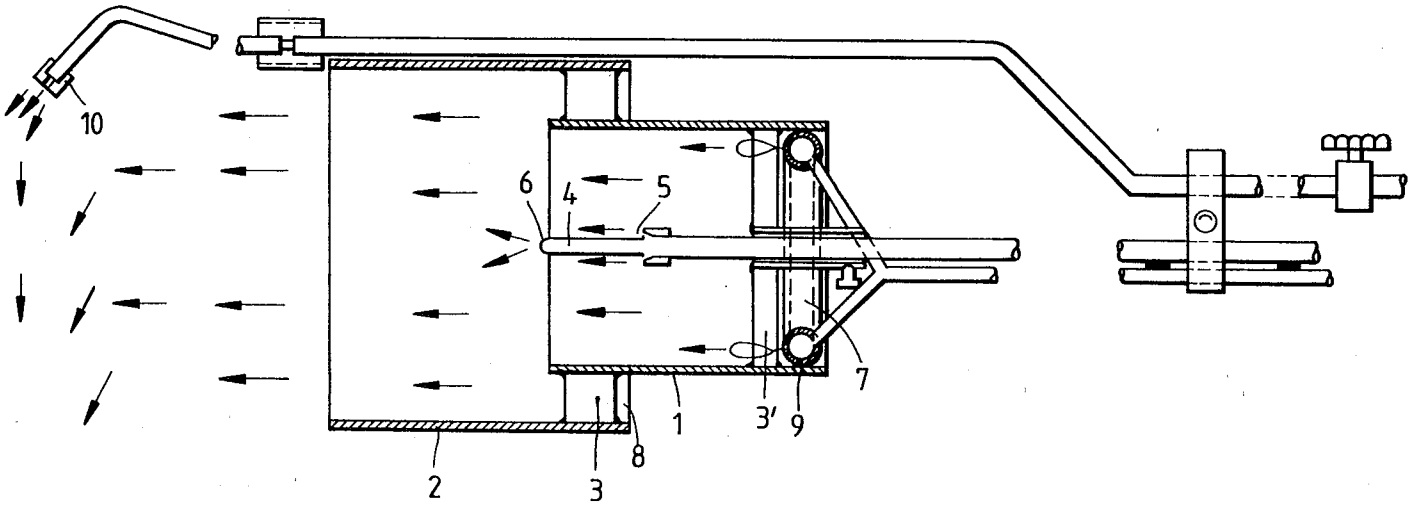
FIG. 1 a burner in axial section shown diagramatically.

The burner in accordance with FIG. 1 consists of a first annular guide-plate 1 and a second annular guide-plate 2 of larger diameter which is arranged concentrically with respect to the first annular guide-plate 1 and is carried by means of spacers 3 on the first annular guide plate 1. The spacers 3 advantageously take the form of inclined vanes.

A channel 4 for introducing compressed air is provided centrally in the first annular guide plate 1 and supported by spacers 3'. At about half way along the axial length of the annular guide plate 1, the channel 4 carries openings 5 in the form of nozzles having a main flow component extending in the axial direction. The end of channel 4 has a nozzle 6 which already lies externally of the annular guide plate 1 and from which compressed air having a main flow component in the axial direction discharges. The nozzle 6 can take the form of a wide slit nozzle, whereby the slit can also be formed by a row of holes.

The annular channels formed by the annular guide-plates 1 and 2 and the channel 4 for the compressed air are open at the back so that, via these openings 7,8, air can be drawn in from the outside. The suction force is produced by the compressed air leaving the nozzles 5,6 which acts as a pumping jet. Introduction of compressed air at two axially displaced planes imparts kinetic energy to the air which is drawn in so that the air in the annular guide plates 1,2 is accelerated in the axial direction as the air volume increases.

In addition to the openings 7,8 at the back, holes may also be provided in the wall of the annular guide plate 1 at its rearward portion.

At the back end of the annular guide plate 1, on its wall, an annular nozzle 9 is provided which, on the side directed towards the annular guide plate 2, has a row of holes through which the combustion gas is discharged. The discharging combustion gas becomes mixed with the air drawn in through the openings 7 at the back, so that an inflammable gas-air mixture for producing an annular flame is produced.

As a result of the double acceleration of the flowing gas mixture along its path to the mouth of the burner, optimal combustion along with good flame stability, a high gas volume and a high flow velocity are achieved. The flame stability is further improved as a result of the cascade arrangement of the annular guide-plates.

Using the same principle as that of the burner which has been described, a spray gun can also be constructed. In such a case, compressed air charged with coating particles is introduced via the central channel 4 or, where separate introduction of the coating substance is used, this is introduced at the discharge plane of the compressed air, and is atomized there. At a second axially-displaced position, further compressed air can be introduced either centrally or in annular fashion in order to produce further acceleration of the flow.

In the example shown in FIG. 1, a further nozzle 10 for introducing compressed air or a liquid medium is arranged at the side of the burner head, the compressed air or liquid medium either being blown on to the surface of the substrate on which the hot gases are impinging or being sprayed into the hot gas jet. Where compressed air is used, particles of dust and dirt which become free upon drying can be blown away. Where a liquid medium such as an activator medium is used, the surface can be activated ready for the coating medium. The nozzle 10 itself, can take the form of a single nozzle or that of a wide slit nozzle. In place of the slit, it is also possible to use a row of holes.

Figure 2:
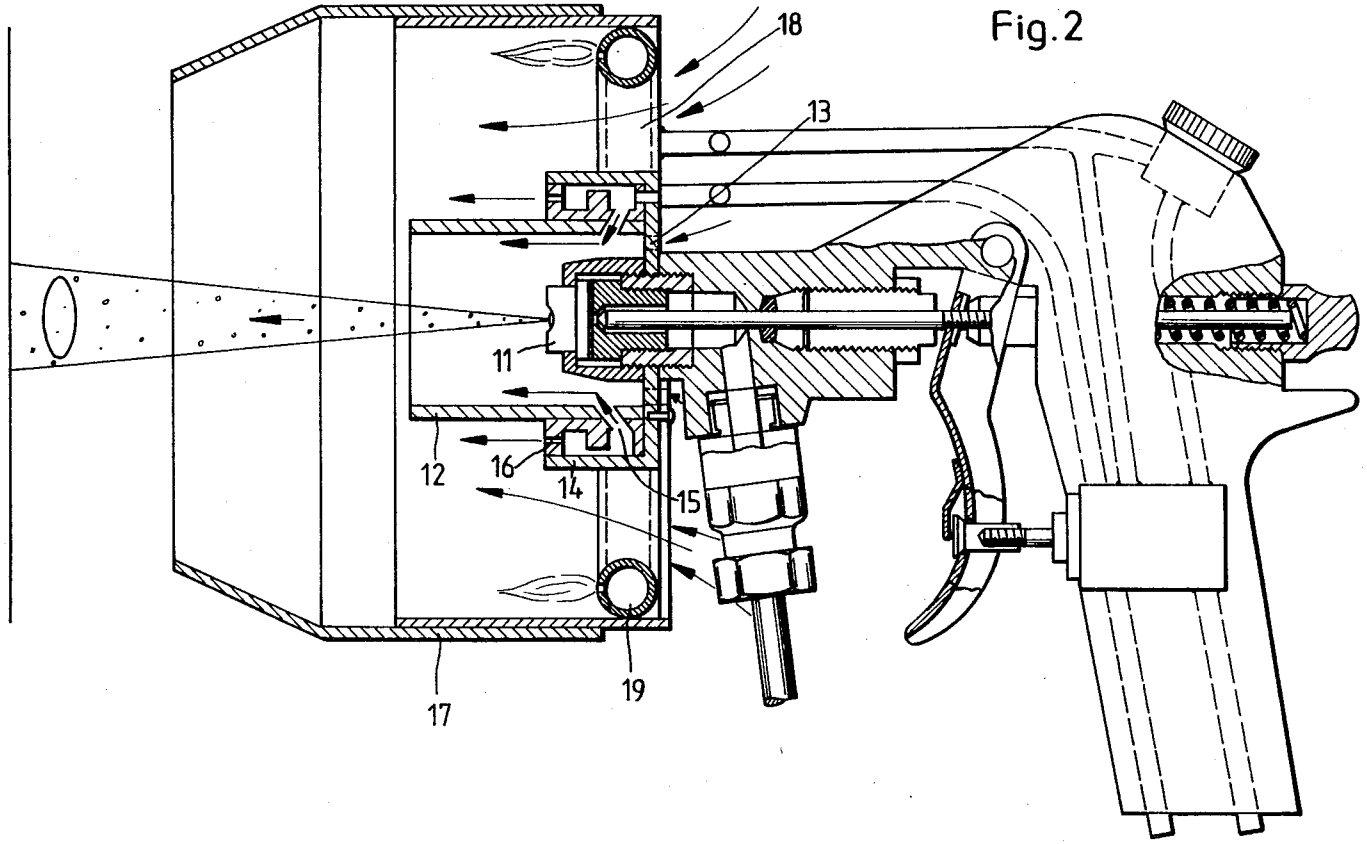
FIG. 2 a spray gun for flame spraying in axial section.

In the case of the spray gun shown in FIG. 2, the coating medium is fed to a central high pressure nozzle 11 having a conical jet. The high pressure nozzle 11 is arranged inside an annular guide plate 12 which has openings 13 at its back to provide for the introduction of air. On the outside of the annular guide plate 12, an annular channel 14 supplied with compressed air, is arranged. From the annular channel 14, compressed air having axial flow components passes, via several nozzles 15 arranged in an annular pattern into the annular channel formed by the annular guide-plate 12 and the high pressure nozzle 11, so that air taken from the atmosphere can be sucked in through the openings 13. From the annular channel 14, compressed air additionally enters the annular channel formed by the annular guide-plate 12 and the annular guide-plate 17 of larger diameter, via axial nozzles 16 arranged in an annular pattern. In the same way as the compressed air leaving the nozzles 15, the compressed air discharged from the nozzles 16 acts as a pumping jet and draws air in through the openings 18 provided at the back. An annular nozzle 19 for introducing combustion gas into the annular channel is provided in the outer annular channel on the inner surface of the annular guide plate 17.

Figure 3:
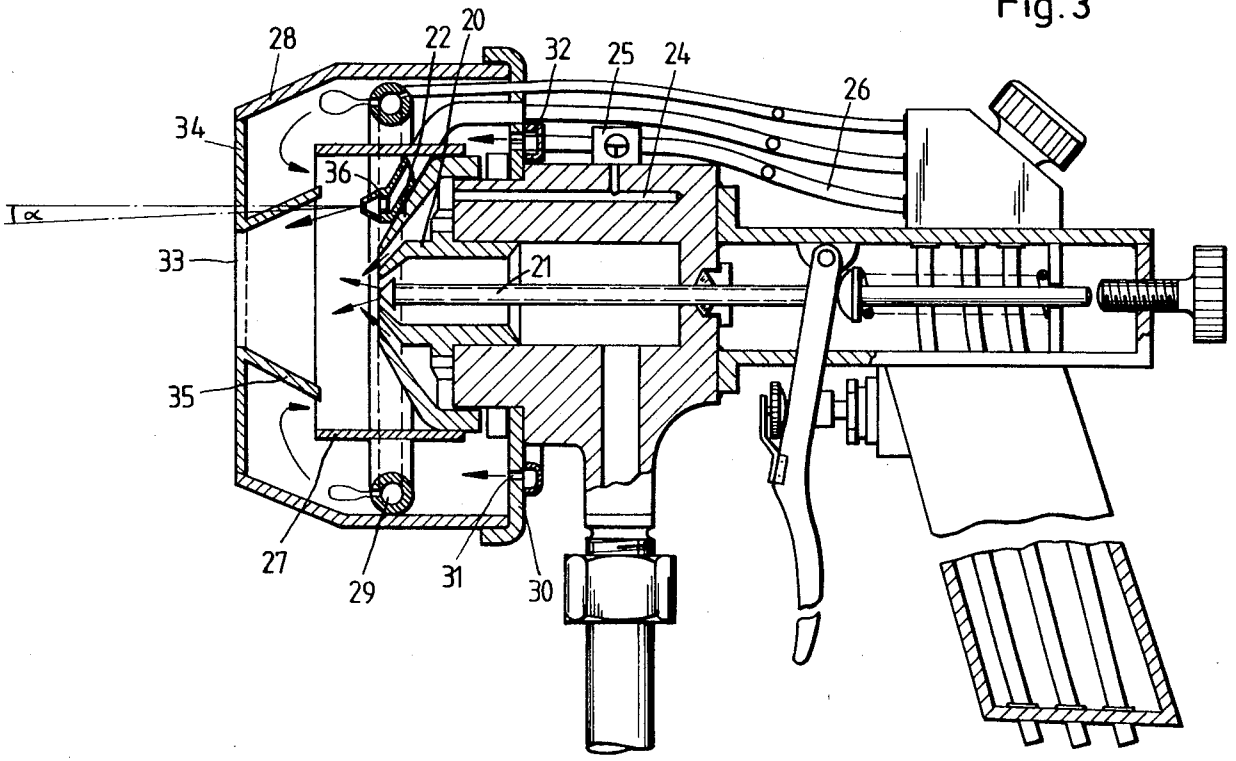
FIG. 3 an underwater gun for carrying out flame spraying in axial section.

In the example of an embodiment shown in FIG. 3, coating material is supplied via a nozzle 20, which can be closed off by means of a central hollow needle 21. Compressed air can be supplied via the hollow needle 21. The nozzle 20 is surrounded by an annular nozzle 22 the annular channel 23 of which is supplied with compressed air via an axial channel 24 and a branch 25 originating from a main channel 26, this atomizing the coating material as it is discharged at the plane of the outlet from nozzle 20. The nozzle arrangement 20 to 22 is surrounded by an inner annular guide plate 27, which together with an outer annular guide plate 28 forms an annular channel in which an annular nozzle 29 for combustion gas is arranged. The annular channel is closed off at the back by means of a plate 30 right up to the openings 31 by means of which, via the intermediary of an annular-shaped distribution channel 32, compressed air can be supplied from the main feed channel 26.

The forward end of the burner is closed off by means of an annular plate 34 right up to the central opening 33, an inwardly projecting hopper-shaped annular guide-plate 35 being connected to the inner edge of this guide-plate. By means of the annular guide plate 35 the effect is achieved of, firstly, directing the jet of hot gases and, secondly producing whirling of the hot gases in the annular space formed by the annular guide plates 28 and 35.

In the case of this embodiment as well, the cross-sectional area in the direction of flow is initially increased in stages, by which means kinetic energy is imparted to the flow at axially displaced planes using the compressed air which is fed in and it is not until the outlet in the region of annular guide plate 34 is reached that the cross-sectional area is reduced.

The burner which has been described is, on account of its encapsulation right up to the forward central opening 33, suitable for use under water. Because of the provision of the central additional compressed air jet through the hollow needle 21, a powerful pumping jet is produced which is able to withstand the external pressure.

In order to clean residues, such as salt, from the dried surface a cleaning medium, particularly fresh water, can be supplied via the central opening 33 and additionally through a nozzle 36. The direction of the jet should be slightly oblique in order to produce a swirling effect.

Good results were obtained with a burner in accordance with the embodiments shown in FIG. 1, in which the diameter of each outer annular guide plate is nearly identical or smaller than twice the diameter of the next smaller annular guide plate and the overall length of the burner is greater than the length of the annular guide plate having the largest diameter. A burner having the following dimensions has proved to be entirely satisfactory:

Inner diameter of the larger annular guide plate 2=110 mm

Inner diameter of the inner annular guide plate 1=80 mm,

Length of the outer annular guide plate 2=110 mm,

Length of the inner annular guide plate 1=70 mm.

Axial overlap of the pair of annular guide plates 1,2=20 mm,

Width of the annular gap, operating as a choke, between the pair of annular guide plates 1,2=20 mm.

Width of the annular gap between the inner diameter of the ring nozzle 9 for combustion gas and the central channel 4, optionally surrounded by a supporting sleeve=20 mm.

I claim:

1. A process for heating a substrate, said process comprising the steps of igniting an inflammable gas-air mixture for forming hot combustion gases within an annular channel; accelerating the hot combustion gases by introducing a first pumping jet of compressed air into said hot combustion gases and further accelerating the hot gases by introducing at least one other pumping jet of compressed air into said gases at a location downstream from the point of introduction of the first jet of compressed air, the separate steps of accelerating the hot combustion gases being carried out while simultaneously introducing combustion air for making the inflammable gas-air mixture.

2. The process of claim 1 including the step of discharging hot combustion gases in the direction of the first pumping jet.

3. The process of claim 2 including the step of discharging hot combustion gases and air in a cascade-like arrangement.

4. The process of claim 2 including the step of applying coating particles simultaneously to the substrate surface during flame spraying.

5. A burner for heating a substrate, which comprises an annular guide, a combustion gas nozzle, and first and second compressed air nozzles, said annular guide surrounding the first compressed air nozzle and spaced therefrom forming an annular channel with air inlets, the combustion gas nozzle disposed so as to discharge hot combustion gases within said annular channel, the first compressed air nozzle accelerating the hot combustion gases by introducing a first pumping jet of compressed air into said gases, and the second compressed air nozzle accelerating the hot combustion gases further by introducing a second pumping jet of compressed air at a location downstream from the point of introduction of compressed air from the first compressed air nozzle.

6. The burner of claim 5 including means for discharging a coating material onto the surface of the substrate.

7. The burner of claim 6 wherein the annular guide is comprised of multiple telescoping annular guide plates with rearward air inlets.

8. The burner of claim 7 wherein the first and second compressed air nozzles are arranged for discharging compressed air at axially displaced planes.

9. The burner of claim 8 wherein the combustion gas nozzle is arranged concentrically.

10. The burner of claim 7 including spaced first and second annular guide plates arranged concentrically forming a further annular channel in which the second air nozzle projects.

11. The burner of claim 10 including means for applying a gaseous medium onto the surface of the substrate.

12. The burner of claim 10 including means for applying a liquid medium onto the surface of the substrate.

13. A burner for heating a substrate surface, which comprises a high pressure nozzle, a first annular guide surrounding said nozzle and spaced therefrom forming a first annular channel with rearward air inlets, said first annular channel including a first compressed air inlet, said burner having at least one further annular guide surrounding the first annular guide in spaced relationship forming a second annular channel having rearward air inlets, the second annular channel including a second compressed air inlet and a combustion gas nozzle for generating hot combustion gases, the compressed air from the first compressed air inlet in the first annular channel being introduced into the hot combustion gases at a location downstream from the point of introduction of compressed air from the second compressed air inlet in the second annular channel.

14. The burner of claim 13 wherein the rearward air inlets include throttling means for regulating the flow of air into the burner.

15. The burner of claim 14 wherein the throttling means comprises inclined vanes.

16. The burner of claim 13 wherein the throttling means comprises a perforated disc.

17. The burner of claim 13 including means for supplying a coating material onto the surface of the substrate.

18. A burner for heating a substrate surface, which comprises nozzle means for discharging coating material onto the substrate, a first annular guide surrounding said nozzle means and spaced therefrom forming an inner annular channel with a first compressed air inlet and first conduit means for supplying the compressed air to said first compressed air inlet, said burner having at least one further annular guide surrounding the first annular guide in spaced relationship forming an outer annular channel having a second compressed air inlet with second conduit means for supplying compressed air to said second compressed air inlet, the outer annular channel having a combustion gas nozzle for generating hot combustion gases, means for interconnecting the inner and outer annular channels such that hot combustion gases generated in the outer annular channel exit the burner only from the inner annular channel.

19. The burner of claim 18 including means for supplying a coating material onto the surface of the substrate.

20. The burner of claim 19 wherein the means for interconnecting includes an annular plate closing the forward end of the burner except for a central opening.

21. The burner of claim 20 in combination with means for discharging a medium for cleaning the substrate.

* * * * *

UNITED STATES PATENT AND TRADEMARK OFFICE

CERTIFICATE OF CORRECTION

PATENT NO. : 4,579,280

DATED : April 1, 1986

INVENTOR(S) : Felix von Rüling

It is certified that error appears in the above-identified patent and that said Letters Patent is hereby corrected as shown below:

On the title page: Item [73] Assignee:

In the address of Assignee, "Fed. Rep. of Germany" should read "The Netherlands"

Signed and Sealed this

Twenty-second Day of June, 1993

*Attest:*

Michael K. Kirk

MICHAEL K. KIRK

*Attesting Officer*

*Acting Commissioner of Patents and Trademarks*